United States Patent [19]

Harris

[11] 3,937,503

[45] Feb. 10, 1976

[54] ROTARY LATCH LOCK

[76] Inventor: Carson E. Harris, 402 Whealton Road, Hampton, Va. 23666

[22] Filed: July 3, 1974

[21] Appl. No.: 485,738

[52] U.S. Cl. ..... 292/153; 70/328

[51] Int. Cl.[2] ..... E05C 1/04

[58] Field of Search ..... 70/287, 288, 302, 303 R, 70/328; 292/153, 154, 181, 189

[56] References Cited

UNITED STATES PATENTS

| | | | |
|---|---|---|---|
| 101,322 | 3/1870 | Smith | 292/57 |
| 659,627 | 10/1900 | Reddick | 70/303 R |
| 1,146,720 | 7/1915 | Leonard | 70/303 R |
| 1,170,398 | 2/1916 | Blazek | 70/5 |
| 1,260,469 | 3/1918 | Smith | 292/153 |
| 1,438,652 | 12/1922 | Knight | 70/185 |
| 1,946,376 | 2/1934 | Whiting | 70/303 R |

*Primary Examiner*—Albert G. Craig, Jr.
*Attorney, Agent, or Firm*—Mason, Fenwick & Lawrence

[57] ABSTRACT

A slide-bolt type latch locking means is disclosed including a rotary member mounted on a shaft for engagement with a latch bolt to hold the latch bolt in locked condition; a rubber washer is compressed by the rotary latch lock and prevents rotation of the latch lock by vibration of the supporting member to maintain the latch lock in position but permitting manual rotation of the latch lock to permit unlocking of the latch-bolt. Another embodiment employs a rotary latch lock mounted on a slide bolt with a radial slot alignable with a fixed lug to permit movement of the slide bolt to an opened condition, a movement not possible when the slot is not aligned with the fixed lug; a compressible washer maintains the latch lock in any given position of rotation.

3 Claims, 16 Drawing Figures

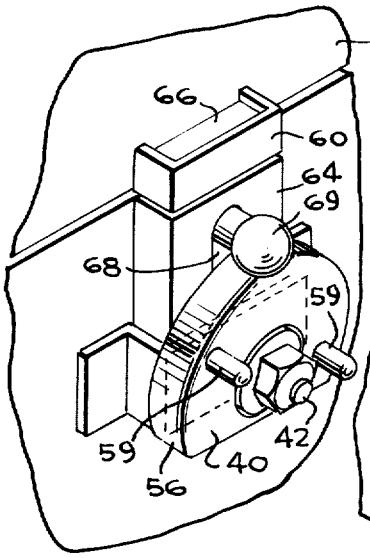
Fig-6
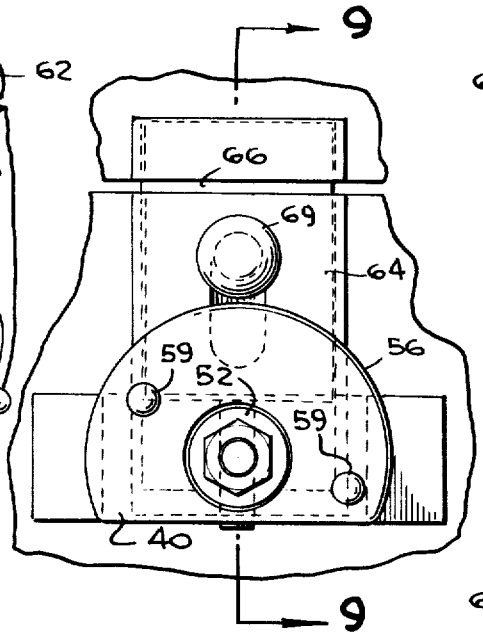
Fig-8
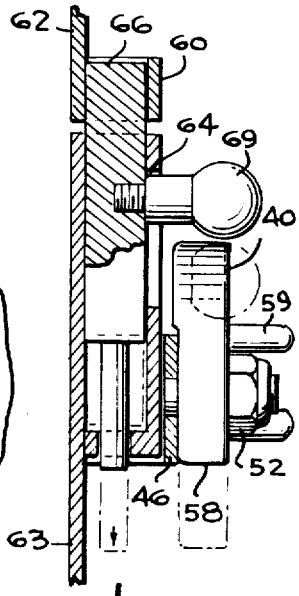
Fig-9
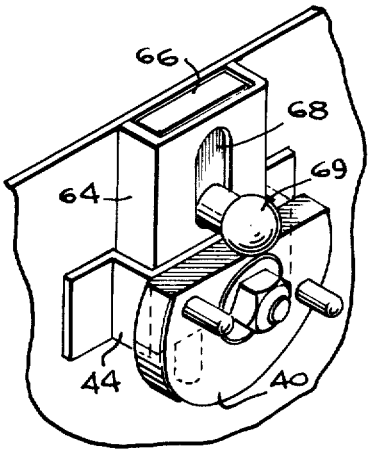
Fig-7
Fig-10
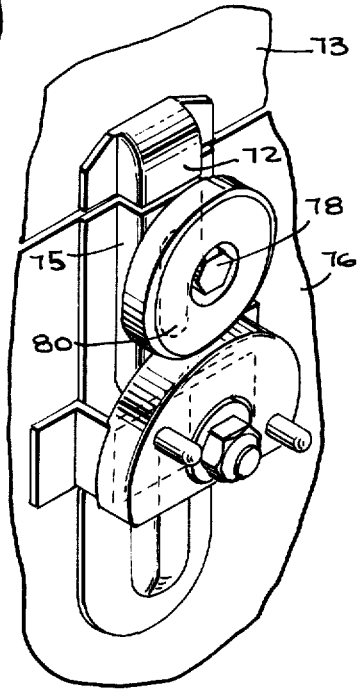
Fig-11
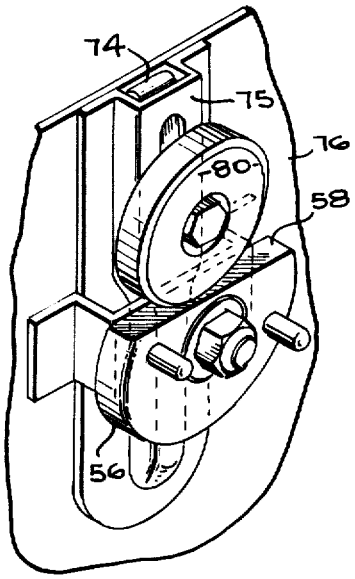

ROTARY LATCH LOCK

BACKGROUND OF THE INVENTION

This invention is broadly in the field of latch devices and is more specifically directed to latching means that is resistant to undesired opening movement caused by vibration of the members on which the latching means is mounted.

Latch means for enabling retention of closures, cabinet doors and the like are employed in a wide variety of devices and embody a similar large number of structural designs. All such latch devices should desirably provide a reliable, easy to use latching function. Unfortunately, many of the prior known devices, while satisfactory for use on rigid, firm support members, have not provided satisfactory performance when mounted on access doors or the like of equipment such as washing machines in which the latch members are subjected to substantial continuous vibration. More specifically, many prior known latching devices employing slide bolt means mounted for movement between a locking position and an unlocked position tend to move toward the unlocked position under the influence of the vibrational forces to which they are subjected. The foregoing is true even in the case of slide-bolt members in which spring means are provided for biassing the slide-bolt toward a locked position.

While it is possible to solve the foregoing problem by the provision of relatively complex structures such as over-center toggle linkages and the like, no simple, inexpensive and easy to use solution to the problem has been proposed prior to the subject invention.

Therefore, it is the primary object of this invention to provide a new and improved latch means.

A more specific object of the invention is the provision of new and improved latch means having latch locking capability resistant to vibrational forces imparted to the latch means by the members on which the latch means is mounted.

A still further object of the invention is the provision of new and improved latch means that is economical to fabricate, easy to use and reliable in operation.

Achievement of the foregoing objects is enabled by the preferred embodiments of the invention through the provision of a rotary latch lock mounted in association with a slide-bolt component of the latch device. The rotary latch lock is supported on a stub shaft for rotation with a compressible washer also being mounted on the stub shaft and biassed against one side of the rotary latch lock to provide a frictional resistance to rotation of the latch lock member. The engagement of the compressible washer with the rotary latch lock serves to maintain the rotary latch lock in any desired position of rotation but permits the latch lock to be manually rotated to such a desired position without undue effort. The rotary latch lock comprises a disc member having a cylindrical outer surface portion about a substantial portion of its periphery and having a chordal surface defining the remaining portion of its periphery. The chordal surface is spaced closer to the axis of the rotary member.

Positioning of the rotary latch lock so that the chordal surface faces means extending from the slide-bolt enables the slide-bolt to move toward the rotary latch lock to an unlocking position. However, the rotary latch lock can be rotated to a second position in which the cylindrical surface faces the slide-bolt when the slide-bolt is in its locked position. Engagement of the cylindrical surface with the slide-bolt when the slide-bolt is in the locked position serves to prevent movement of the slide-bolt toward the unlocked position. Moreover, the friction washer engageable with the rotary latch lock serves to maintain the latch lock in any position of rotation so that vibration will not result in movement of the latch lock to permit the slide bolt to become unlocked under the influence of such vibrations.

In another embodiment of the invention, the rotary latch lock is mounted on the slide-bolt in a position adjacent a fixed bracket lug for rotation about a stub shaft. In this embodiment, an identical compressible friction washer engages the rotary latch lock to maintain the latch lock in any given position of rotation while permitting manual adjustment of the latch lock without undue effort. The outer surface of the rotary latch lock of the last-mentioned embodiment is cylindrical for the most part, but is interrupted by a radial slot of a width greater than the width of the stop lug. Rotation of the latch lock to a position in which the radial slot is aligned with the stop lug enables movement of the latch lock and the slide-bolt to an unlocked position. However, movement of the slide-bolt to a locked position and positioning of the rotary latch lock with the cylindrical surface facing the stop lug prevents movement of the slide-bolt to the unlocked position. The members will remain in the foregoing position due to the operation of the compressible washer engaging the rotary latch lock.

A better understanding of the manner in which the preferred embodiments of the invention achieve the objects of the invention will be enabled when the following written description is considered in conjunction with the appended drawings.

DESCRIPTION OF THE DRAWINGS

FIG. 6 is a perspective view of another embodiment of the invention illustrating the component parts in a locked condition;

FIG. 7 is a perspective view of the embodiment of FIG. 6 illustrating the component parts in an unlocked condition;

FIG. 8 is a front elevation view of the embodiment of FIG. 6;

FIG. 9 is a sectional view taken along lines 9—9 of FIG. 8;

FIG. 10 is a perspective view of another embodiment of the invention illustrating the component parts in a locked condition;

FIG. 11 is a perspective view of the embodiment of FIG. 10 illustrating the component parts in an unlocked condition;

DESCRIPTION OF THE PREFERRED EMBODIMENTS

Figures 1, 2, 3, 4, 5:
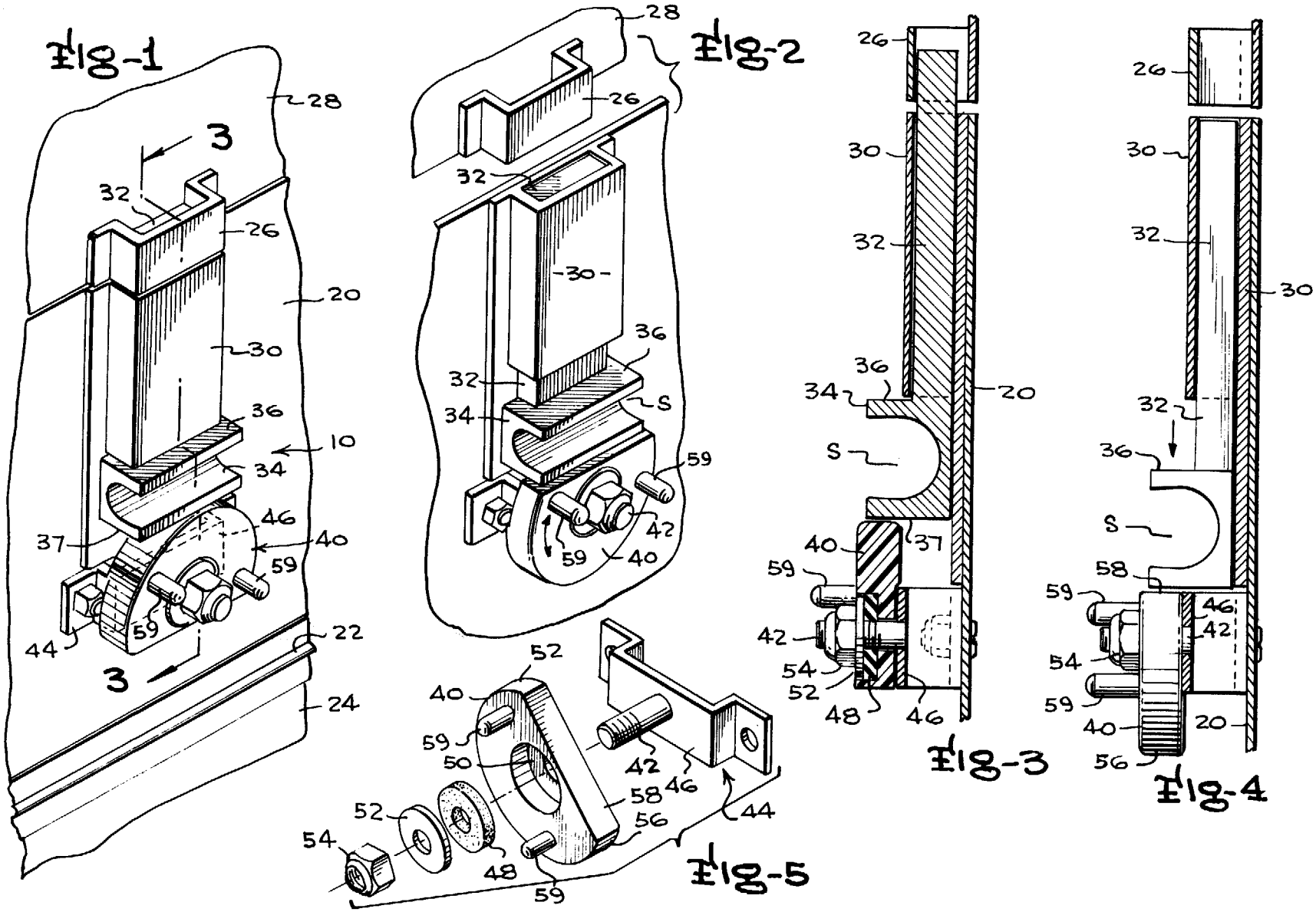
FIG. 1 is a perspective view of the preferred embodiment of the invention illustrating the latch member components in a locked condition.
FIG. 2 is a perspective view of the latch members of FIG. 1 illustrating the latch member components in an unlocked condition.
FIG. 3 is a sectional view taken along lines 3—3 of FIG. 1.
FIG. 4 is a sectional view taken along the same lines as FIG. 3 but illustrating the parts in an unlocked condition as in FIG. 2.
FIG. 5 is an exploded perspective view of the latch lock components of the preferred embodiment.
Figure 12:
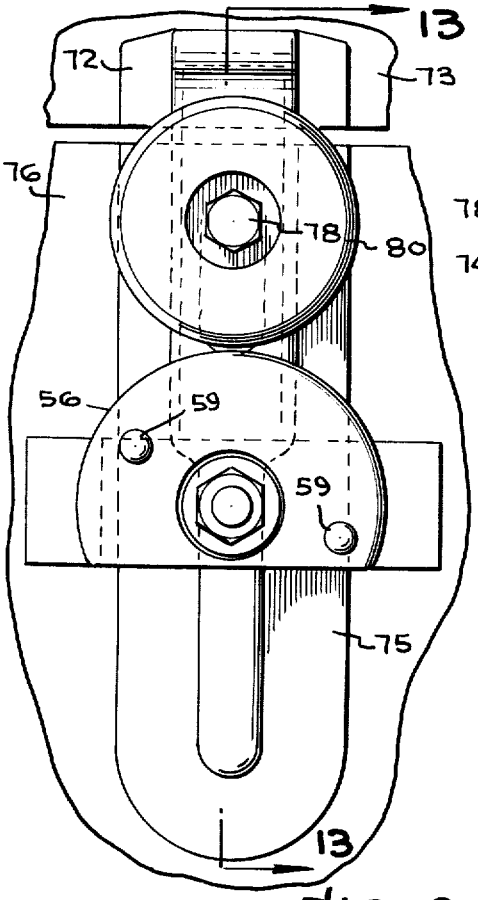
FIG. 12 is an elevational view of the embodiment of FIG. 10 illustrating the parts in a locked condition.
Figure 13:
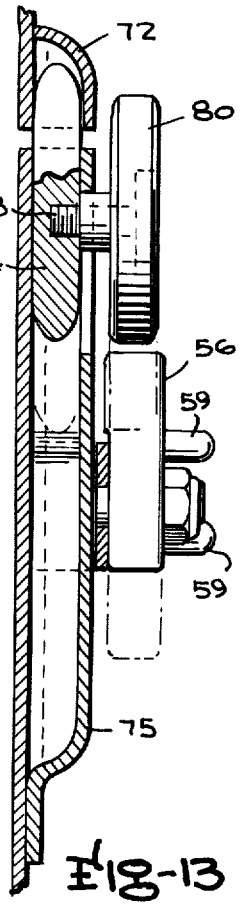
FIG. 13 is a sectional view taken along lines 13—13 of FIG. 12.

Attention is initially invited to FIG. 1 of the drawings which illustrates the preferred embodiment of the invention, generally designated 10, mounted on a door or panel member 20 supported by a hinge 22 on a housing 24. A keeper 26 is fixedly attached to an upper portion 28 of the housing and a slide-bolt guide means 30 is fixedly attached to the door or panel 20.

A slide-bolt 32 is mounted for axial reciprocation in the slide-bolt guide means 30 with a slide-bolt actuator 34 being fixedly connected to the lower end of the slide-bolt 32 as best shown in FIG. 2. Slide-bolt actuator 34 is larger than the opening in the slide-bolt guide 30 and the upper surface 36 consequently serves as a stop for limiting the extent of upward movement which the slide-bolt 32 is capable of achieving. Additionally, it should be noted that the slide-bolt actuator 34 also includes a forwardly facing open slot S as shown in FIG. 2 which is provided for receipt of an actuator rod or the like employed on doors or panels using latch members of this type.

Slide-bolt 32 is capable of movement between an extended or locking position illustrated in FIG. 1 and a retracted or unlocking position illustrated in FIG. 2. In the extended position, the upper end of the slide-bolt is received within the keeper 26 in a well-known manner while in the retracted position, the slide-bolt end is fully enclosed and received within the slide-bolt guide 30 as shown in FIG. 2.

Latch lock means for maintaining the slide-bolt in a locked or extended position is provided below the slide-bolt actuator 34 and comprises a rotary latch lock 40 mounted on a stub shaft 42 for rotation in a manner to be discussed. Stub shaft 42 is supported by a U-shaped bracket member 44 including a spanner portion 46 and mounted on the door or panel member 20 as best shown in FIG. 1. A compressible vibration damping means consisting of a compressible washer 48 formed of material such as neoprene having a hardness of approximately 60 durometer is mounted on the stub shaft 42 and received in a cylindrical recess 50 on the outer face of the rotary latch lock member 40 as shown in FIG. 3. A metal washer 52 engages the outer face of the compressible washer 48 under the influence of a retainer nut 54 so that the washer 48 is slightly compressed and serves to provide resistance to rotation of the rotary latch lock 40 in an obvious manner. However, the rotary latch lock 40 is capable of manual rotation as desired.

Rotary latch lock 40 has a first outer peripheral surface 56 concentric about the axis of stub shaft 42 and the opening in the latch lock through which the stub shaft passes and which comprises a cylindrical surface.

The remainder of the peripheral surface of the rotary latch lock 40 comprises a second peripheral surface 58 which is a planar chordal surface with respect to the cylindrical surface 56 and which is obviously more closely spaced to the axis of stub shaft 42 than is the cylindrical surface 56. Two manually engageable actuator protrusions 59 for enabling rotation of latch lock 40 extend outwardly from the front face of member 40.

When the rotary latch lock 40 is positioned with the cylindrical surface 56 engaging the lower face 37 of the slide-bolt actuator 34, it is impossible for the slide-bolt 32 to move from the locked position as illustrated in FIGS. 1 and 3. On the other hand, when the rotary latch lock 40 is positioned with the chordal surface 58 facing the lower face 37 of actuator 34, the slide-bolt 32 can move to its retracted or unlocking position illustrated in FIGS. 2 and 4. When the slide-bolt is held in the locking position of FIGS. 1 and 3, vibrational forces do not have any rotational effect on the latch lock 40 and the slide-bolt consequently remains locked regardless of the influence of such vibrational forces. However, the latch lock 40 can be easily rotated by manual gripping of protrusions 59 to enable an unlocking movement of the latch bolt to the position illustrated in FIGS. 2 and 4.

The embodiment illustrated in FIGS. 6–9 is similar to the embodiment of FIGS. 1–5 with the latch components comprising a keeper 60 mounted on a fixed panel component 62, a slide-bolt guide 64 supporting a slide-bolt 66 for axial reciprocation. The slide-bolt guide 64 has a slot 68 in its outer face through which a lug 69 extends. The lug 69 is in facing relation to a rotary latch lock 40 identical to the rotary latch lock of the first embodiment. The rotary latch lock 40 is mounted on a U-shaped bracket 44 identical to the first bracket 44 extending transversely across the slide-bolt guide 64 and supporting the rotary latch lock 40 in exactly the same manner. It will be apparent that positioning of the rotary latch lock 40 with its cylindrical surface 56 facing the lug 69 as in FIGS. 6 and 8 will serve to retain the slide-bolt 66 in a locked position as thus illustrated in said figures. The rotary latch lock is held in position by a compressible washer in exactly the same manner and employing exactly the same construction as that illustrated in FIG. 5.

FIG. 7 illustrates the rotary latch lock in a position permitting the slide-bolt 66 to be moved to its unlocked position.

Turning now to FIGS. 10–13, it will be noted that these figures illustrate another embodiment of the invention including a keeper 72 mounted on a fixed panel 73 for receiving the outer end of a slide-bolt 74 mounted for reciprocation in a slide-bolt guide means 75 fixed to the face of a movable door or panel 76. A slot is provided in the outer face of the slide-bolt guide 75 in a manner essentially identical to the slot provided in the slide-bolt guide 64 of the last-discussed embodiment, and a support lug 78 extends outwardly from the slide-bolt 74 for providing support on its outer end for an actuator knob 80. A rotary latch lock 40 identical to the previously discussed latch lock is supported on an identical U-shaped bracket and is mounted below the actuator knob 80 and can be rotated to the position illustrated in FIG. 12 for holding the slide-bolt 74 in a locked condition. Alternatively, the latch lock 40 can be rotated to the position illustrated in FIG. 11 for permitting the slide-bolt 74 to move to its unlocked position. Since the rotary latch lock 40 of the embodiment of FIGS. 10–13 is mounted in an identical manner to the previously discussed latch locks, the compressible washer associated therewith serves to retain the latch lock in any position of rotation in which it is occupying.

Figure 14:
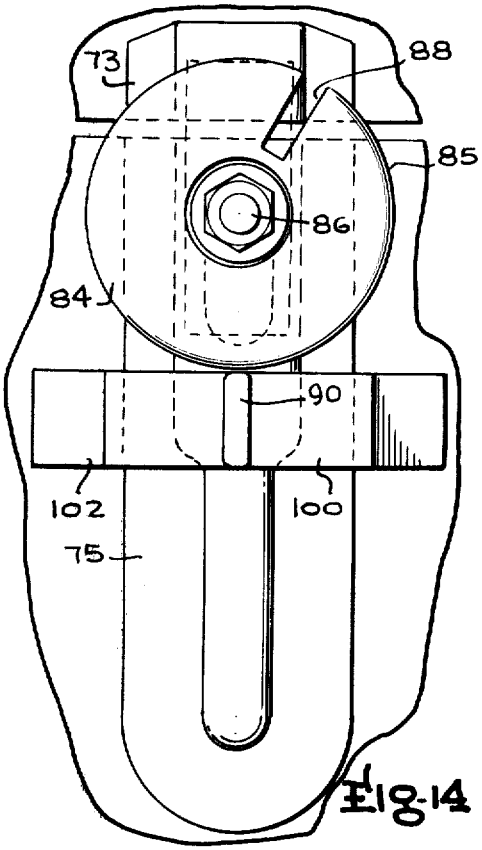
FIG. 14 is a front elevation view of another embodiment of the invention illustrating the component parts in a locked condition.
Figure 16:
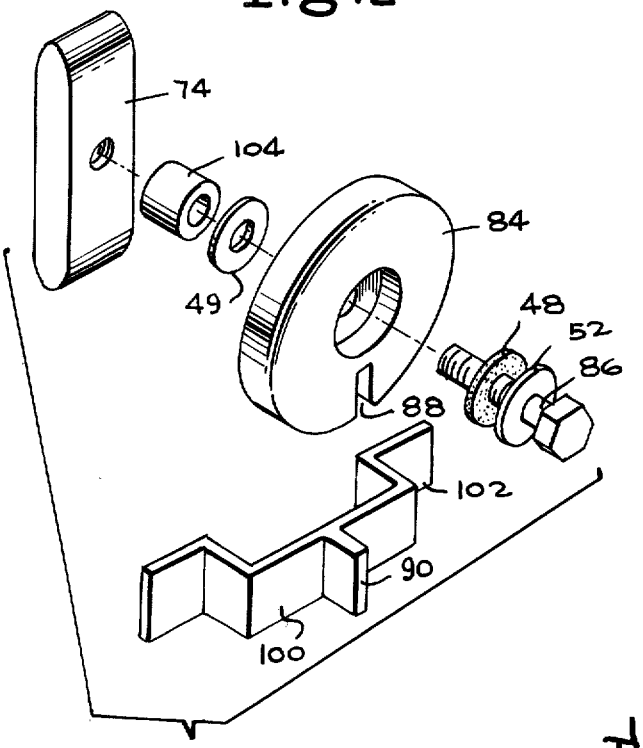
FIG. 16 is an exploded perspective view of the slide-bolt and latch lock components of the embodiment of FIG. 14.
Figure 15:
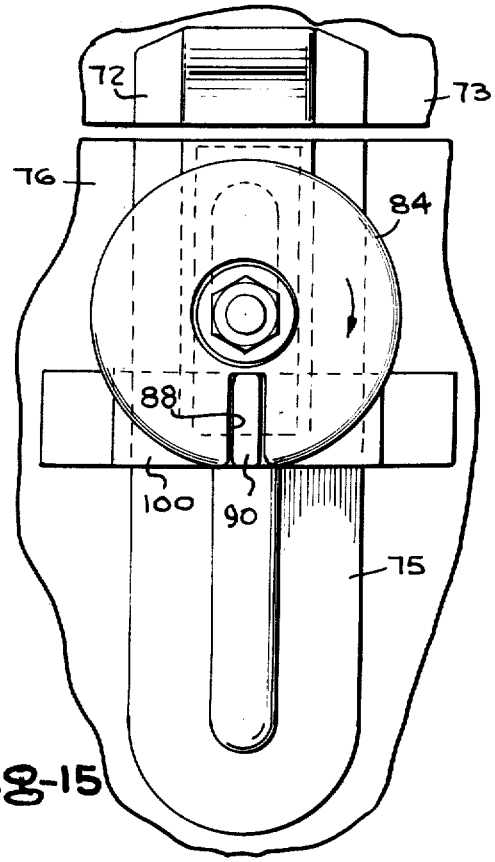
FIG. 15 is a front elevation view of the embodiment of FIG. 14 illustrating the component parts in an unlocked condition.

Turning now to FIGS. 14–16, it will be noted that these figures illustrate another embodiment of the invention which constitutes a modification of the device illustrated in FIGS. 10–13. The last embodiment employs a keeper 72 mounted on a fixed panel 73 in conjunction with a movable door or closure 76 on which a slide-bolt guide 75 containing a slide-bolt 74 is mounted. The parts of the last embodiment discussed in the preceeding sentence having the same reference numerals as the parts in the last-discussed embodiment are identical to the like numbered parts of the last-discussed embodiment of FIGS. 10, etc.

However, the embodiment of FIGS. 14–16 employs a latch lock member 84 mounted for positionable rotation on a stub shaft bolt 86 extending through the slot in the outer face of the slide-bolt guide 75. A slot 88 extends inwardly radially from the outer periphery of the latch lock 84 and is of a sufficient width to be received over a stop lug 90 extending outwardly from a spanner portion 100 of a U-shaped bracket plate 102 fixedly connected to the movable door or panel member 76. When the latch lock 84 is in the position illustrated in FIG. 14, its outer cylindrical peripheral portion 85 engages the stop lug 90 to prevent the slide-bolt from moving to the unlocking position. However, rotation of the latch lock 84 to the position illustrated in FIG. 15 in which the slot 88 is aligned with the stop lug 90 permits the movement of the slide-bolt to the unopened position. The latch lock 84 is mounted as shown in FIG. 16 with a spacer 104 engaging a washer 49 and a washer 52 engaging a compressible washer 48 which is identical to the previously discussed washer member bearing the same designator. Consequently, the rotary latch lock 84 tends to remain in any given position in which it is rotationally positioned, but can be manually rotated for enabling an unopening of the slide-bolt 74. Latch lock 84 can also be provided with protrusions like members 59 if desired.

While numerous modifications of the subject invention will undoubtedly occur to those of skill in the art, it should be understood that the spirit and scope of the invention is to be limited solely by the appended claims.

I claim:

1. A latching means resistant to accidental opening such as caused by vibration of the means on which the latching means is mounted, said latching means comprising a slide-bolt, actuator means extending outwardly from said slide-bolt, guide means supporting said slide-bolt for axial movement between an extended or locking position and a retracted or unlocked position, a rotary latch lock means mounted on said actuator means for movement along a path of movement therewith, means mounting said rotary latch lock on said actuator means for rotation about an axis perpendicular to the axis of said slide-bolt, a fixed stop lug mounted in the path of movement of said rotary latch lock, compressible vibration damping means clampingly engaged between said actuator means and said rotary latch lock for resisting rotation of said latch lock for holding said rotary latch lock in any rotary position of adjustment notwithstanding the vibrations of the means on which the latching means is mounted while permitting manual rotary adjustment of said rotary latch lock to another position of rotational adjustment, said rotary latch lock including a first peripheral surface comprising a portion of a cylinder and a second peripheral surface portion in a chordal plane with respect to said portion of a cylinder positioned radially inwardly from said first peripheral surface so that positioning of said second peripheral surface portion in facing relation to said stop lug enables said slide-bolt to move to its retracted position while positioning of said first peripheral surface in facing relation to said stop lug when said slide-bolt is in said locking position results in engagement of said first peripheral surface with said stop lug to prevent movement of said slide-bolt toward said unlocked position wherein said stop lug is mounted on support means comprising a U-shaped bracket plate fastened to and extending outwardly from means on which said guide means supporting said slide-bolt is mounted with said U-shaped bracket plate including a spanner portion extending transversely across and spaced outwardly from said slide-bolt, said stop lug extending outwardly from said spanner portion, said second peripheral surface of said rotary latch lock comprising the bottom of a generally rectangular slot extending inwardly from said first peripheral surface and dimensioned to matingly fit over said stop lug when aligned therewith.

2. The invention of claim 1 wherein said actuator means comprises bolt means extending outwardly from said slide-bolt, said bolt means having an axis parallel to the axis of said stop lug.

3. The invention of claim 2 wherein said compressible vibration damping means comprises a washer member having an axial opening through which said actuating means extends, said washer member being in a compressed condition to resist rotational movement of said latch lock.

* * * * *